United States Patent [19]

Satoh

[11] Patent Number: 4,826,033

[45] Date of Patent: May 2, 1989

[54] FOLDING FOOD TAKE-OUT DEVICE

[75] Inventor: Kou Satoh, Tokyo, Japan

[73] Assignees: Mitsubishi Corporation; Satoh Shosan Ltd., both of Tokyo, Japan

[21] Appl. No.: 172,816

[22] Filed: Mar. 25, 1988

[51] Int. Cl.[4] ..... B65D 25/52

[52] U.S. Cl. ..... 220/85 D; 30/323

[58] Field of Search ..... 220/85 D; 30/322, 323

[56] References Cited

U.S. PATENT DOCUMENTS

| | | | |
|---|---|---|---|
| 910,914 | 1/1909 | Daly et al. | 30/322 |
| 1,274,358 | 7/1919 | Hotnam | 30/322 |
| 3,208,625 | 9/1965 | Trabacchi | 220/85 D X |
| 3,908,887 | 9/1975 | Leto | 220/85 D X |
| 4,036,398 | 7/1977 | Hoogvelt et al. | 220/85 D X |
| 4,432,466 | 2/1984 | Allen | 220/85 D X |
| 4,610,087 | 9/1986 | Mickelson et al. | 30/322 X |

FOREIGN PATENT DOCUMENTS 57-23333 5/1982 Japan .

*Primary Examiner*—Harvey C. Hornsby
*Assistant Examiner*—Frankie L. Stinson
*Attorney, Agent, or Firm*—Armstrong, Nikaido, Marmelstein & Kubovcik

[57] ABSTRACT

Disclosed is a folding food take-out device which comprises a food take-out portion and a handle portion connected to or integrally formed with the food take-out portion. The handle portion comprises a plurality of longitudinally extending sections at least of which is foldable and mating engaging elements are formed on the handle portion sections to detachably maintain the handle portion sections intheir engaging condition.

10 Claims, 5 Drawing Sheets

FOLDING FOOD TAKE-OUT DEVICE

BACKGROUND OF THE INVENTION

This invention relates to a folding food take-out device formed of a suitable synthetic resin and more particularly, to a folding food take-out device adapted to be shrink-packaged together with a food container and unfolded when food is taken out of the container.

One example of the prior art folding take-out devices is disclosed in Japanese Utility Model Appln. Publication No. 23333/1982 wherein a synthetic resin food container lid comprises a lid body having a peripheral edge adapted to fit on a container and an annular shoulder for supporting an indication paper sheet, the improvement comprising a pair of ears provided on said shoulder in diametrically opposite positions of the shoulder extending inwardly of the shoulder and a thick food take-out member integrally formed at the opposite ends thereof with said ears.

In the prior art described above, since the food take-out member is integrally formed with the interior of the synthetic resin lid body, the length of the take-out member is constant. Thus, although the food take-out member is employed with a soft azuki-bean jelly container the diameter of the opening of which is greater than the height (depth), when the food take-out member is employed with an instant noodle cup the diameter of the opening of which is smaller than the height (depth), the food takeout member encounters difficulty in taking the noodle from the bottom of the cup.

Although a long food take-out member which can be satisfactorily employed with the container such as the instant noodle cup has been proposed, when the long food take-out member is laid on the upper surface or side wall of the cup and shrink-packaged together with the cup by a wrapper, there is the problem that one or the opposite ends of the take-out member protrude out of the package and thus, the take-out member can not be integrally packaged with the cup.

The present invention has been developed to solve the problems inherent in the prior art food take-out members referred to hereinabove.

SUMMARY OF THE INVENTION

With the above-mentioned problems in mind, the present invention provides an improved food take-out device which can effectively eliminate the problems inherent in the prior arts an which can be satisfactorily shrink-packaged together with a food container by a wrapper without one or the opposite ends thereof protruding out of the package.

The food take-out device of the present invention generally comprises a food take-out portion and a handle portion connected to or integrally formed with the takeout portion.

In one embodiment of the invention, the handle portion comprises two longitudinally extending foldable sections with a central area interposed therebetween and mating engaging elements formed on the sections and central area.

In another embodiment of the invention, the handle portion comprises a longitudinally extending stationary section and a foldable section with a central area interposed therebetween and mating engaging elements formed on the stationary and foldable sections.

In another embodiment of the invention, the handle portion comprises two longitudinally extending foldable sections of T-cross-section and a longitudinally extending stationary section of sector cross-section connected together by folding areas and mating engaging elements formed on the three sections.

The above and other objects and attendant advantages of the present invention will be more readily apparent to those skilled in the art from a reading of the following detailed description in conjunction with the accompanying drawings which show preferred embodiments of the invention for illustration purpose only, but not limiting the scope of the invention in any way.

PREFERRED EMBODIMENTS OF THE INVENTION

Figure 1:
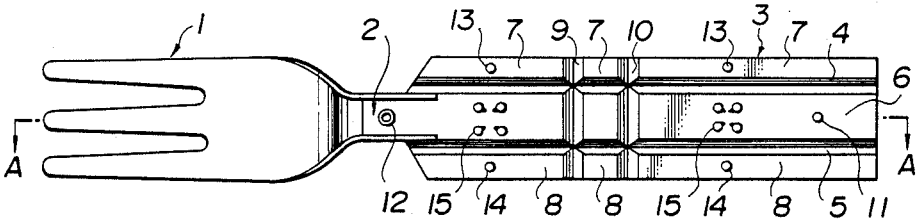
FIG. 1 is a plan view of a first embodiment of the food take-out device of the invention.
Figure 2:
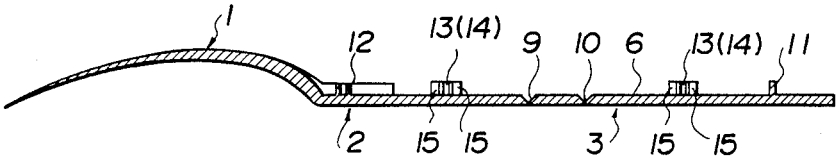
FIG. 2 is a side sectional view of the embodiment of FIG. 1.
Figure 3:
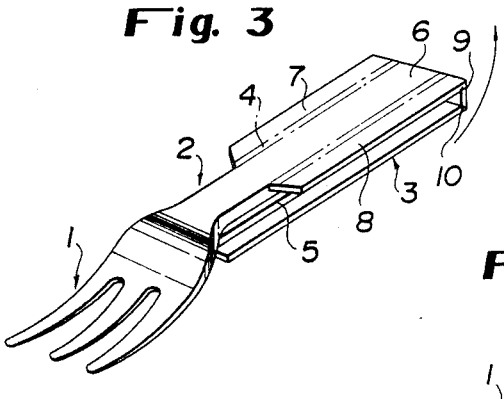
FIG. 3 is a perspective view of said embodiment of the food take-out device showing the food take-out device in its folded condition.
Figure 4:
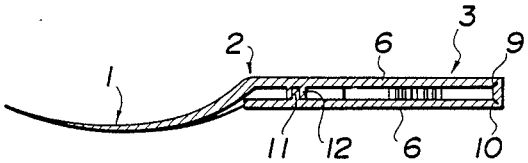
FIG. 4 is a longitudinally sectional view of the folding food take-out device in the folded condition as shown in FIG. 3.

The present invention will be now described referring to the accompanying drawings and more particularly, to FIGS. 1 to 9 inclusive wherein the first embodiment of the folding food take-out device of the present invention is illustrated. The folding food take-out device generally comprises a leading or food take-out portion 1 having a holed projection 12 adjacent to the base end thereof and a handle portion 3. The food take-out portion 1 and handle portion 3 are formed of a suitable synthetic resin. In the illustrated embodiment, the take-out portion 1 is in the form of a fork and secured at the base end to the reverse side of the adjacent or leading end portion of the handle portion 3 by adhesive. As more clearly shown in FIGS. 1 and 2, the reverse side of the handle portion 3 is provided with a pair of parallel and spaced grooves 4, 5 of V-cross-section extending in the longitudinal direction of the handle portion 3 to define a central portion 6 therebetween. The distance between the V-cross-section grooves 4, 5 corresponds to the width of the base end portion of the take-out portion 1. The area from the outer side of each V-cross-section groove 4 or 5 to each side edge of the handle portion 3 is formed as a folding section 7 or 8. Also provided on the reverse side of the handle portion 3 at substantially the central area thereof are two transverse grooves 9 and 10 of the V-cross-section which extend at right angles to the grooves 4 and 5 and are spaced in the longitudinal direction of the handle portion. A projection 11 is provided on the reverse side of the central area 6 of the handle portion 3 adjacent to the end of the handle portion remote from the end thereof where the take-out portion is secured and adapted to be snapped into the holed projection 12 in the take-out portion and portion 2 when the take-out device is folded back. The reverse sides of the folding sections 7 and 8 are provided with projections 13 and 14, respectively. Two groups of projections 15, 15 are provided on the reverse side of the central area 6 between the groove 9 and holed projection 12 and between the groove 10 and projection 11, respectively. In the illustrated embodiment, each projection group comprises four projections arranged in two parallel and spaced rows each including two longitudinally spaced projections. The space between the two longitudinally spaced projections 15 in each row corresponds to the thickness of the associated projection 13 or 14 whereby when the folding parts 7, 8 are folded back along the grooves 4, 5 and the central area 6 is folded back along the grooves 9, 10. Each projection 13 or 14 is snapped into between the associated longitudinally spaced projections 15 and the projection 11 is snapped into the holed projection 12 to thereby detachably hold the take-out device in its folded condition. The projections 13, 14 and 15 form engaging means in the take-out device of the present invention. The engaging means are more clearly shown in FIG. 6(I) on an enlarged scale. As shown in this figure, the free ends of the projections 13, 14 are increased in diameter or bulged outwardly as shown by reference numerals 13a, 14a, respectively. Thus, when the folding parts 7, 8 are folded at substantially right angles to the central area 6, the projections 13, 14 enter the spaces between the projections 15, 15 in the aligned and spaced relationship from above and the bulged free ends of the projections 13, 14 prevent the projections from inadvertently coming out of the spaces.

Figure 7:
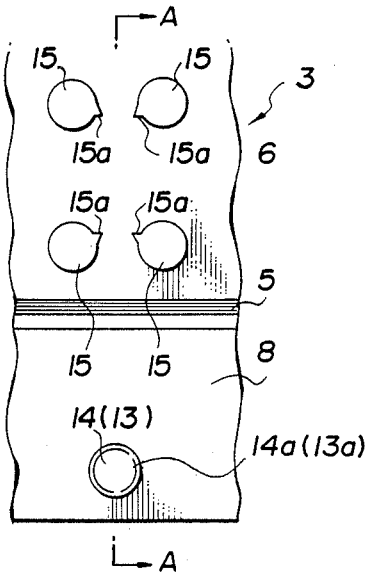
FIG. 7 is a fragmentary plan view on an enlarged scale of the engaging means of the first embodiment of the food take-out device of the invention.
Figure 8:
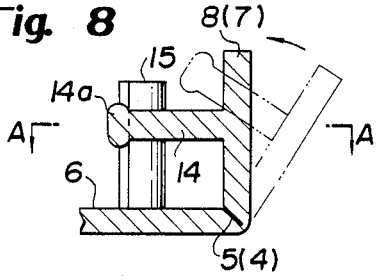
FIG. 8 is a fragmentary side sectional view of FIG. 7.
Figure 9:
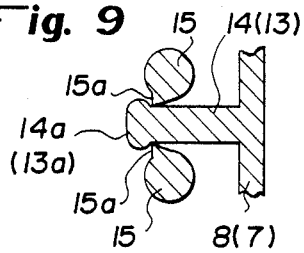
FIG. 9 is a cross-sectional view taken along substantially the line A—A of FIG. 8.

As more clearly shown in FIGS. 7, 8 and 9, each projection 15 is formed with a continuous or discontinuous rib 15a extending longitudinally along the inner side thereof. Thus, when the projection 13 or 14 is snapped into between the longitudinally spaced projections 15, the bulged end 13a or 14a of the projection 13 or 14 engages the ribs 15a on the projections 15 to maintain the two folding sections 7 and 8 into their unfolded condition.

Figure 6I:
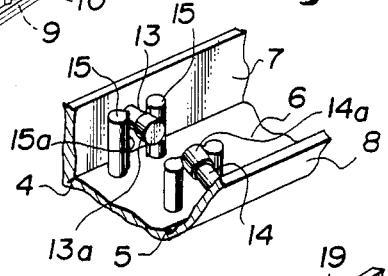
FIG. 6(I) is a fragmentary perspective view on an enlarged scale of the engaging means in the folding food take-out device.
Figure 6:
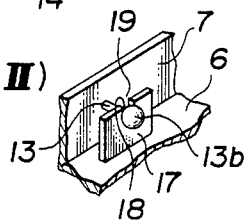
FIG. 6(II) is similar to FIG. 6(I), but shows a modification of the engaging means.

The engaging means is not limited to the arrangement shown in FIG. 6(I), but may be the arrangement wherein in place of the groups of projections 15, a plurality of upright boards 17 are provided on the reverse side of the central area 6 in spaced relationship in the longitudinal direction of the central area. One of the upright boards 17 is shown in FIG. 6(II). As shown in this figure, the upright board 17 has a recess 18, the upper edge of which is constricted as shown by reference numeral 19 and the free end of the projection 13 is formed as having a spherical shape bulge as shown by reference numeral 13*b*.

When the folding food take-out device as described hereinabove is not used or in its storage condition, the handle portion 3 is folded back along the transverse V-cross-section grooves 9, 10 leaving the folding sections 7, 8 in their unfolded condition and the projection 11 at the central area 6 is received in the holed projection 12. Since the handle portion 3 is folded back onto the take-out portion 1 with the folding sections 7, 8 maintained in their unfolded condition, the height of the handle portion 3 is not greater than the distance between the longitudinal V-cross-section grooves 4, 5 and the length of the take-out device in its folded condition is about one half of the take-out device in its unfolded condition. Thus, even when the device is shrink-packaged together with a food container by a wrapper, one or the opposite ends thereof would not protrude out of the package.

Figure 5:
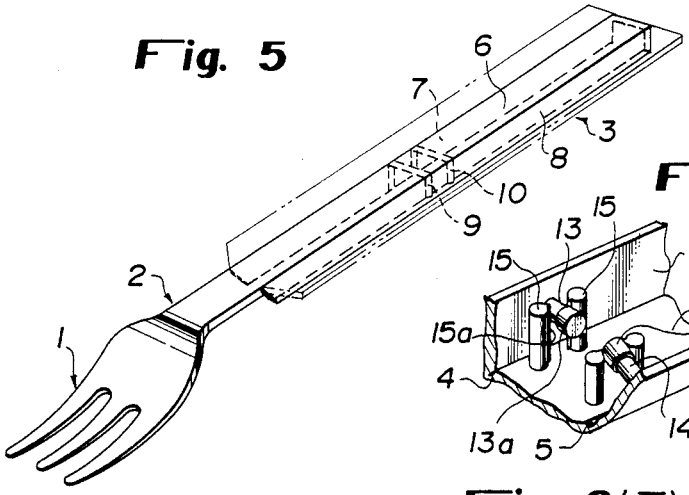
FIG. 5 is a perspective view of the folding food take-out device showing the device in its use or unfolded condition.

When the food take-out device is used for taking food out of the container, the wrapper is torn, the handle portion 3 is unfolded from its folded condition, the folding sections 7, 8 are folded back along the grooves 4, 5 and elements of the engaging means are caused to engage each other by slightly pushing the elements with finger tips, then, the handle portion 3 will have the V-shaped cross-section as shown in FIG. 5.

With the take-out device in this unfolded condition, the length of the device becomes a maximum as shown in FIG. 5 and since the whole of the handle portion 3 is reinforced by the folding sections 7, 8 folded back at substantially right angles to the central area 6, the handle portion 3 is imparted with sufficient strength on both the inside and outside thereof and thus, the food take-out device can be satisfactorily used without bending.

Figure 10:
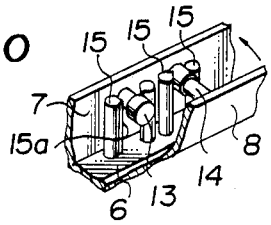
FIG. 10 is a fragmentary perspective view of a further modification of the engaging means.

FIG. 10 fragmentarily shows a further modification of the engaging means wherein a plurality of longitudinally spaced projections 15 are provided in a single row on the reverse side of the central area 6 and the projections 13, 14 provided on the folding sections 7, 8, respectively are adapted to be snapped into between the associated adjacent projections 15 when the folding sections are folded back. In the modified engaging means of FIG. 10, since the projections are arranged in the single row on the central area 6, the width of the handle portion 3 can be made narrower than the central area of the foregoing embodiment where the projections are arranged in two rows.

Thus, according to the first and second embodiments of the invention, in the storage condition of the take-out device, the handle portion lies over the take-out portion to thereby reduce the length of the handle portion and the food take-out device can be attached to the upper surface of the associated food container and shrink-packaged together with the container by a wrapper. When the food-take-out device is used, the wrapper is torn and the food take-out device is detached from the container. Then, the handle portion is unfolded and the holding sections are folded back until the elements of the engaging means engage each other whereby the take-out device will have length and rigidity sufficient to take food out of the container.

Figure 11:
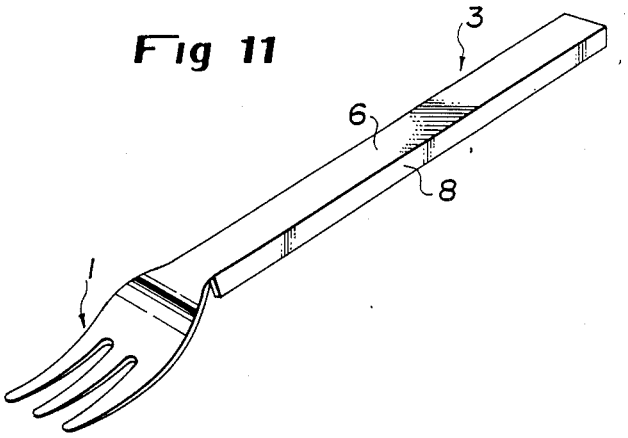
FIG. 11 is a second embodiment of the food take-out device of the invention.

FIG. 11 shows the second embodiment of the folding food take-out device of the invention wherein the food take-out portion 1 is not provided with the base end portion as in the first embodiment, but internally formed with the central area 6 of the handle portion 3. The other parts of the second embodiment are identical with the corresponding parts of the first embodiment.

Figure 12I:
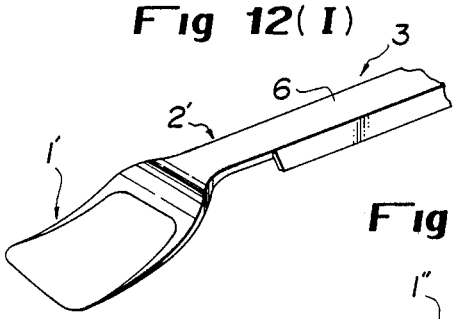
FIG. 12(I) is a perspective view of the food take-out portion in the form of a spoon.
Figure 12:
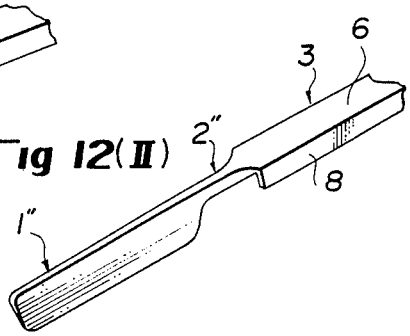
FIG. 12(II) is a perspective view of the food take-out portion in the form of a knife.
Figure 13:
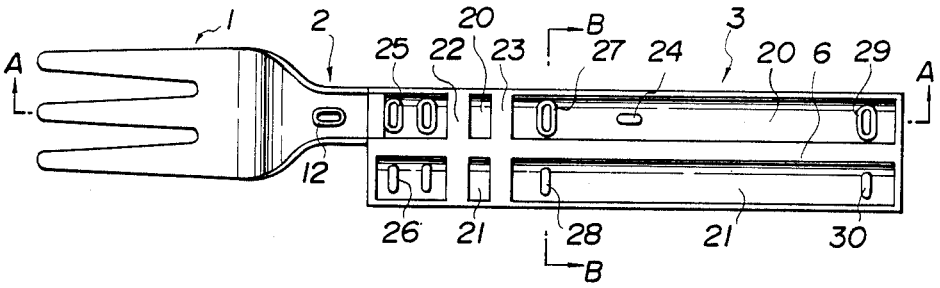
FIG. 13 is a reverse side plan view of a third embodiment of the folding take-out device of the invention.
Figure 14:
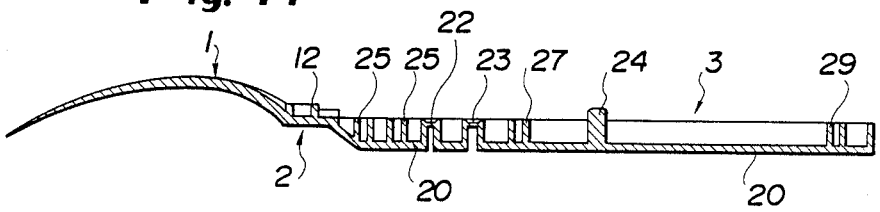
FIG. 14 is a longitudinally sectional view taken along substantially the line A—A of FIG. 13.

FIG. 12(I) shows the food take-out portion in the form of a spoon 1' having the based end portion 2' secured to the central area 6 of the handle portion 3. FIG. 12(II) shows the food take-out portion in the form of a knife 1'' having the base end 2'' secured to the central area 6 of the handle portion 3.

FIGS. 13 to 17 inclusive show the third embodiment of the food take-out device of the invention. The third embodiment of the food take-out device generally comprises a food take-out portion 1 having a base end portion 2 and a handle portion 3. The take-out portion and handle portion are integrally formed from a suitable synthetic resin. The reverse side of the take-out portion 1 is formed with a holed projection 12. The handle portion 3 comprises two longitudinally extending mating sections 20, 21 of semi-circular cross-section connected together by a thinned central area 6 interposed therebetween. Two spaced thinned folding areas 22 and 23 are provided on the reverse side of the handle portion 3 transversing the section 20, central area 6 and section 21 to thereby divide each of the mating sections 20, 21 into three zones. The section 21 is movable about the thinned area 6 relative to the section 20.

The reverse side of the section 20 is provided with a projection 24 to be detachably snapped into the holed projection 12 when the section 21 is folded back about the area 6 over the section 20. Two holed projections 25 are provided on the reverse side of the section 20 between the base end of the take-out portion 2 and the thinned folding area 22 in spaced relation in the longitudinal direction of the section 20 and similary, two projections 26 are provided on the reverse side of the foldable section 21 in spaced relationship in the longitudinal direction of the section. The positions of the projections 26 correspond to those of the holed projections 25. Also provided on the reverse side of the section 20 between the folding area 23 and projection 24 is a holed projection 27. Similarly, another projection 28 is provided on the reverse side of the foldable section 21 in the position to be snapped into the holed projection 27 when the section 21 is folded back about the thinned area 6.

A holed projection 29 is provided on the reverse side of the section 20 at the end of the section remote from the end thereof where the projections 25 are provided.

On the reverse side of the foldable section 21 there is also provided a projection 30 in the position corresponding to the position of the holed projection 29. The projections 25, 26, 27, 28, 29 and 30 constitute engaging means.

Figure 15:
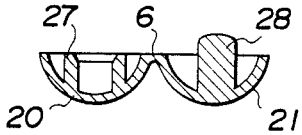
FIG. 15 is a cross-sectional view of the engaging means of the embodiment of FIG. 10 taken along substantially the line B—B of FIG. 13.
Figure 16:
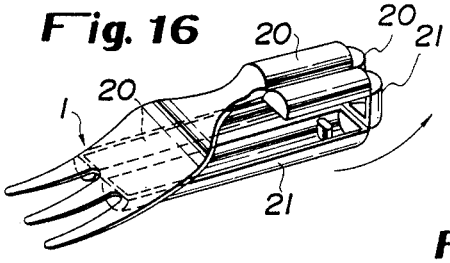
FIG. 16 is a perspective view of the food take-out device as shown in FIG. 13 showing the device in its folded condition.
Figure 17:
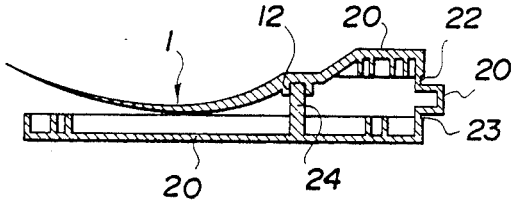
FIG. 17 is a longitudinally sectional view of the food take-out device as shown in FIG. 13 in the folded condition.
Figure 18:
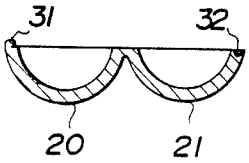
FIG. 18 is similar to FIG. 15, but shows a modification of the engaging means as shown in FIG. 13.

The engaging means of the third embodiment of the take-out device are not limited to the arrangement as described hereinabove. The engaging means may be any other arrangement provided that the sections of the semicircular cross-section sections can detachably engage with each other when the foldable section 21 is folded back about the thinned area 6 over the section 20. A portion of a modification of the engaging means is illustrated in FIG. 15 and in the modified engaging means the free side edge of the section 20 is provided with a continuous or discontinuous tongue 31 and the free side edge of the foldable section 21 is provided with a continuous or interrupted groove 32 so that the sections can detachably engage with each other.

When the food take-out device is not used for taking food out of the food container, the handle portion 3 is folded back along the thinned folding areas 22, 23 onto the take-out portion 1 with the sections 20, 21 held in their disengaged condition so as to engage the projection 24 into the holed projection 12. Thus, although the thickness of the take-out device increases, the length of the device becomes about one half of the device when the device is in its unfolded condition.

When the food take-out device is unfolded to be used for taking food out of the food container, the section 21 is folded back along the central area 6 to lie over the mating section 20 and thereafter, the sections 20, 21 are slightly pushed towards each other to cause the elements of the engaging means to engage each other to provide the handle portion 3 having a circular cross-section. The circular cross-section handle portion has sufficient strength to resist bending and/or breakage in use.

As mentioned hereinabove, when the third embodiment of the food take-out device is not used and storaged, the foldable section lies over the other section to thereby reduce the length of the device. Thus, even when the take-out device is attached to the upper surface of the food container and the assembly is packaged by a wrapper, any part of the take-out device will not protrude out of the wrapper. In use, the foldable section is unfolded until the elements of the engaging means on the two sections engage each other to thereby provide the circular cross-section handle portion having length and rigidity sufficient to use.

Figure 19:
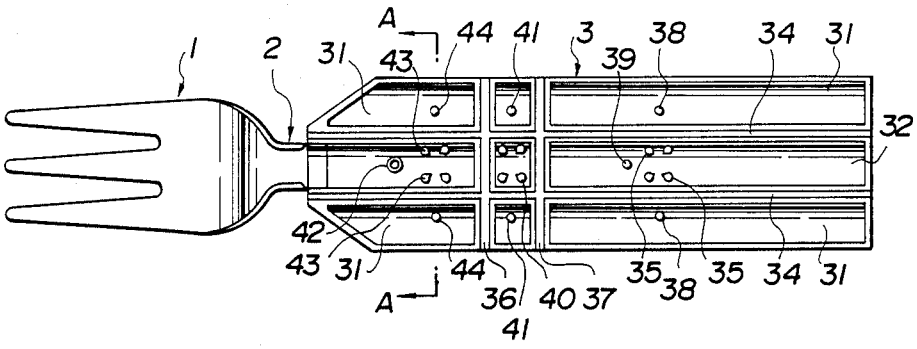
FIG. 19 is a reverse side plan view of a fourth embodiment of the folding take-out device of the invention showing the device in its unfolded conditions.
Figure 20:
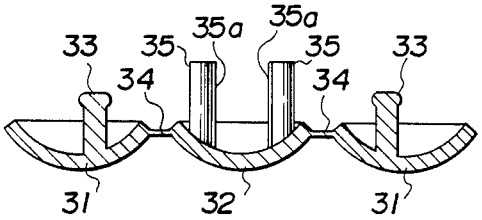
FIG. 20 is a cross-sectional view on an enlarged scale taken along substantially the line A—A of FIG. 1.
Figure 21:
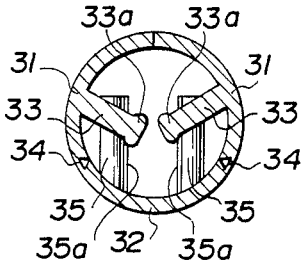
FIG. 21 is a cross-sectional view showing the engaging means of FIG. 20 in its unfolded condition.

FIGS. 19, 20 and 21 show the fourth embodiment of the food take-out device of the present invention. The embodiment generally comprises a food take-out portion 1 having the base end portion 2 suitably connected to a handle portion 3. The take-out portion 1 and handle portion 3 are formed of a suitable synthetic resin. The handle portion 3 comprises two sections, 31 of T-shaped cross section and a section 32 of sector cross-section which have substantially the same arcuate length. Each of the sections 31 has an engaging projection 33 extending inwardly from the inner surface thereof and having the bulged free end 33a. The sections 31, 32 are connected together by thinned areas 34. Projections 35 extend uprightly from the inner surface of the section 32 and have continuous or discontinuous ribs 35a on their inner surfaces. The number of the projections 35 is four and the projections are arranged in two parallel and spaced rows each consisting of two projections spaced in the longitudinal direction of the section 32. A projection 38 is provided on the reverse side of each part 31 in a position to snap into between the projections 35 in each row. Two parallel and spaced thinned or folding areas 36 and 37 are provided extending transversely of the reverse sides of the sections 31, 32 and 31. A projection 38 is provided on the reverse side of the section 32 between the folding area 37 and the two left side projections 35. A projection 39 is provided on the reverse side of the section 32 in a position to be snapped into the holed projection 12 when the handle portion 3 is folded along the folding areas 36, 37. Four projections 40 are provided on the reverse side of the section 32 between the two parallel and spaced transverse folding areas 36, 37 and the projections 40 are arranged in two parallel and spaced rows in the longitudinal direction of the section 32. A projection 41 is provided on the reverse side of each section 31 in a position to snap into between the two projections 40 in each row. A holed projection 42 is provided on the reverse side of the section 32 adjacent to and inwardly spaced from the end of the section close to the base end of the take-out portion 1. Four projections 43 are provided on the reverse side of the section 32 and arranged in two parallel and spaced rows in the longitudinal direction of the section. A projection 44 is provided on the reverse side of each section 31 in a position to snap into between the two projections 43 in each row.

As mentioned hereinabove in connection with the foregoing embodiments, when the take-out device is not used for taking food out of the food container, the handle portion 3 is folded back along the folding areas 36, 37 with the sections 31, 32 left in their disengaged condition and then the sections 31, 32 are folded back along the longitudinal areas 34 onto the section 32 until the elements of the engaging means on the sections engage each other.

Figure 22:
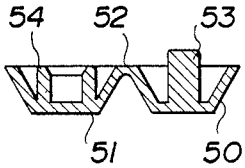
FIG. 22 is a cross-sectional view of a modification of the engaging means as shown in FIG. 12.

FIG. 22 fragmentarily shows modified handle portion sections 50 and 51 which are of inverted trapezoid cross-section. The sections are connected together by a thinned or folding area 52. A projection 53 extends uprightly from the inverse side of the section 50 and in the longitudinal direction of the section. A holed projection 54 extends uprightly from the inverse side of the section and in the longitudinal direction of the section for snugly receiving the projection 53.

With the above arrangement of the fourth embodiment, since the section 32 of sector cross-section is provided with the pair of projections 35 and the sections 31 of T-cross section are provided with the projections 33 with the bulged free ends 33*a*, when the sections 31 are folded back along the thinned areas 34 to lie over the section 32, the bulged free ends 33*a* of the projections 33 automatically engage the ribs 35*a* on the projections 35 to thereby positively maintain the three sections in their assembled condition. The three sections can be automatically assembled without being pushed with finger tips and provide the circular cross-section handle portion wherein no room for insertion of fingers is left.

While the present invention has been particularly shown and described with reference to the preferred embodiments thereof, it will be understood by those skilled in the art that various changes in form and details may be made therein without departing from the spirit and scope of the present invention.

What is claimed is:

1. A folding food take-out device adapted to be attached to a food container and shrink-packaged together with said container by a wrapper comprising:

a food take-out portion;

a handle portion connected to or integrally formed with said food take-out portion and comprising transverse folding areas and a plurality of longitudinally extending handle sections at least one of which is foldable and two parallel and spaced folding areas extending transversely of the reverse side of said handle sections; and engaging means provided on the reverse side of said handle sections.

2. The folding food take-out device as set forth in claim 1 wherein said handle portion comprises two handle sections foldably connected to the opposite sides of the central area of said handle portion by means of two parallel and spaced longitudinally extending folding areas formed on the reverse side of said handle portion and said engaging means comprise each two parallel and spaced rows of ribbed projections formed on the reverse side of said central area in two longitudinally spaced positions, each row including two longitudinally spaced projections and two longitudinally spaced projections with bulged ends formed on the reverse side of each of said foldable handle sections to be snapped into between the two longitudinally spaced ribbed projections in the associated row of ribbed projections when said foldable handle sections are folded back along said longitudinal folding areas.

3. The folding food take-out device as set forth in claim 2 wherein said engaging means comprise each single row of ribbed projections formed on the reverse side of said central area of the handle portion in two longitudinally spaced positions, each row including two longitudinally spaced projections and two longitudinally spaced projections with bulged ends formed on the reverse side of each of said foldable handle sections, each projection with bulged ends being adapted to be snapped into between the two ribbed projections in each single row of said ribbed projections when the handle sections are folded back along said longitudinal folding areas.

4. The folding food take-out device as set forth in claim 2 wherein said engaging means comprise two longitudinally spaced recessed projections formed on the reverse side of said central area of the handle portion, the upper edges of said recesses being constricted, and projections with bulged ends formed on the reverse side of each of said foldable handle sections with each being positioned to be snapped into each of the constricted recesses of said recessed projection.

5. The folding food take-out device as set forth in claim 1 further including a holed projection formed on the reverse side of one end portion of said food take-out portion or at one end portion of said handle portion and a projection formed on the reverse side of the other end portion of the handle portion to be snapped into said holed projection.

6. The folding food take-out device as set forth in claim 1 wherein said food take-out portion is in the form of a fork.

7. The folding food take-out device as set forth in claim 1 wherein said food take-out portion is in the form of a spoon.

8. The folding food take-out device as set forth in claim 1 wherein said food take-out portion is in the form of a knife.

9. The folding food take-out device as set forth in claim 1 wherein said handle portion comprises two handle sections connected together by means of a folding area and said engaging means comprise a stationary handle section and a foldable handle section connected together by means of an intervening folding area and said engaging means comprise longitudinally spaced holed projections formed on the reverse side of said stationary handle section and projections formed on the reverse side of said foldable handle section corresponding to said holed projections with respect to the number and positions so that said projections are snapped into the holed projections when the foldable handle section is folded back along said intervening folding area.

10. The folding food take-out device as set forth in claim 1 wherein said handle portion comprises two foldable handle sections of T-cross-section and one stationary handle section of sector cross-section connected together by means of folding areas and said engaging means comprise a plurality of longitudinally spaced projections formed on the reverse side of said stationary handl section and projections with bulged ends formed on the reverse side of said foldable handle sections, the number and positions of said projections with bulged ends being so selected that the bulged projections are snapped into between respectively two longitudinally spaced adjacent ribbed projections to engage the ribs on the ribbed projections when the foldable sections are folded back.

* * * * *